US012163422B2

(12) United States Patent
Alkhuwayr et al.

(10) Patent No.: US 12,163,422 B2
(45) Date of Patent: Dec. 10, 2024

(54) METHOD TO TEST EXPLORATION WELL'S HYDROCARBON POTENTIAL WHILE DRILLING

(71) Applicant: SAUDI ARABIAN OIL COMPANY, Dhahran (SA)

(72) Inventors: Asim K. Alkhuwayr, Dammam (SA); Mohammed T. Mojbel, Khobar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 590 days.

(21) Appl. No.: 17/392,972

(22) Filed: Aug. 3, 2021

(65) Prior Publication Data

US 2023/0038120 A1 Feb. 9, 2023

(51) Int. Cl.

| | |
|---|---|
| ***E21B 43/34*** | (2006.01) |
| ***E21B 44/00*** | (2006.01) |
| ***E21B 47/10*** | (2012.01) |
| ***E21B 49/08*** | (2006.01) |

(52) U.S. Cl.

CPC ..... *E21B 49/087* (2013.01); *E21B 43/34* (2013.01); *E21B 47/10* (2013.01); *E21B 44/00* (2013.01)

(58) Field of Classification Search

CPC ..... E21B 49/087; E21B 43/34; E21B 47/10; E21B 44/00; E21B 49/088; E21B 21/085; E21B 2200/22

See application file for complete search history.

(56) References Cited

U.S. PATENT DOCUMENTS

| | | | | |
|---|---|---|---|---|
| 3,351,135 | A | 11/1967 | Jensen | |
| 7,762,131 | B2 | 7/2010 | Ibrahim et al. | |
| 2003/0037926 | A1* | 2/2003 | Sask | E21B 21/16 166/305.1 |

(Continued)

FOREIGN PATENT DOCUMENTS

| | | | |
|---|---|---|---|
| CA | 1330432 | C | 6/1994 |
| CN | 101139925 | B | 7/2012 |

(Continued)

OTHER PUBLICATIONS

Wikipedia "Underbalanced drilling" (Year: 2007).*

(Continued)

*Primary Examiner* — Manuel A Rivera Vargas

(74) *Attorney, Agent, or Firm* — Osha Bergman Watanabe & Burton LLP

(57) ABSTRACT

A method for performing a drill stem test (DST) is disclosed. The method includes performing underbalanced drilling (UBD) of exploration wells to penetrate a target interval in a subterranean formation, where UBD is performed when a wellbore fluid pressure is less than a formation fluid pressure to allow a fluid flow from the target interval to surface during a drilling phase of the UBD, determining, based on the UBD of the exploration wells, a measure of the fluid flow from the target interval to the surface, obtaining, based on the UBD of the exploration wells, open hole logs of the exploration wells, where the open hole logs represent a reservoir property of the target interval, and selectively performing, based at least on the measure of the fluid flow and the open hole logs, the DST of the exploration wells.

17 Claims, 8 Drawing Sheets

(56) References Cited

U.S. PATENT DOCUMENTS

| | | | | |
|---|---|---|---|---|
| 2015/0361791 | A1* | 12/2015 | Gisolf | E21B 49/008 166/264 |
| 2016/0130927 | A1* | 5/2016 | Waid | E21B 43/114 166/185 |
| 2016/0292322 | A1* | 10/2016 | Samuel | E21B 41/00 |
| 2019/0284933 | A1* | 9/2019 | Tiwari | E21B 33/124 |
| 2021/0003003 | A1* | 1/2021 | Proett | E21B 49/081 |

FOREIGN PATENT DOCUMENTS

| | | | |
|---|---|---|---|
| WO | 2008106544 | A2 | 9/2008 |
| WO | 2021006930 | A1 | 1/2021 |

OTHER PUBLICATIONS

Al-Maashari et al.; "Underbalanced Drilling (UBD) as a Tool to Test Tight Gas Plays—An Example from the Empty Quarter, Saudi Arabia: Drilling and Reservoir Characterisation Lessons"; SPE 141845; Society of Petroleum Engineers Inc.; Sep. 2011 (15 pages).

M. H. Ab Latip et al.; "Underbalanced Drilling in High Temperature Malay Basin Basement With Nitrified Water—Mitigating Foaming and Corrosion Issues", OTC-26677-MS, Offshore Techonology Conference, Mar. 22, 2016, pp. 1-15 (15 pages).

First Examination Report issued in Saudi Arabia Application No. 122440009, dated Oct. 12, 2023 (6 pages).

* cited by examiner

METHOD TO TEST EXPLORATION WELL'S HYDROCARBON POTENTIAL WHILE DRILLING

BACKGROUND

Drill stem test is an oil and gas exploration procedure to isolate, stimulate and flow a subterranean formation to determine the fluids present and the rate at which they can be produced. Drill stem tests are performed to evaluate the economic potential of completing the formation drilling by identifying productive capacity, pressure, permeability or extent of an oil or gas reservoir. Drill stem tests are performed by deploying a series of tools known as a test bottomhole assembly (BHA). A basic drill stem test BHA includes a packer or packers, which act as an expanding plug to be used to isolate sections of the well for the testing process, valves that may be opened or closed from the surface during the test, and recorders used to document pressure during the test. In addition to packers, a downhole valve is used to open and close the formation to measure reservoir characteristics such as pressure and temperature which are charted on downhole recorders within the BHA.

SUMMARY

In general, in one aspect, the invention relates to a method for performing a drill stem test (DST). The method includes performing underbalanced drilling (UBD) of a plurality of exploration wells to penetrate a target interval in a subterranean formation, wherein UBD is performed when a wellbore fluid pressure is less than a formation fluid pressure to allow a fluid flow from the target interval to surface during a drilling phase of the UBD, determining, based on the UBD of the plurality of exploration wells, a measure of the fluid flow from the target interval to the surface, obtaining, based on the UBD of the plurality of exploration wells, open hole logs of the plurality of exploration wells, wherein the open hole logs represent a reservoir property of the target interval, and selectively performing, based at least on the measure of the fluid flow and the open bole logs, the DST of the plurality of exploration wells.

In general, in one aspect, embodiments disclosed herein relate to a well system for performing a drill stem test (DST). The system includes a drill string for performing underbalanced drilling (UBD) of each of a plurality of exploration wells to penetrate a target interval in a subterranean formation, wherein a wellbore fluid pressure is less than a formation fluid pressure to allow a fluid flow from the target interval to surface during a drilling phase of the UBD, a multi-phase flow meter for determining, based on the UBD of each of the plurality of exploration wells, a measure of the fluid flow from the target interval to the surface, a testing-while-drilling tool for obtaining, based on the UBD of each of the plurality of exploration wells, open hole logs of the plurality of exploration wells, wherein the open hole logs represent a reservoir property of the target interval, and a DST tool for selectively performing, based at least on the measure of the fluid flow and the open hole logs, the DST of the plurality of exploration wells.

In general, in one aspect, embodiments disclosed herein relates to a non-transitory computer readable medium (CRM) storing computer readable program code for performing a drill stem test (DST). The computer readable program code, when executed by a computer, includes functionality for performing underbalanced drilling (UBD) of a plurality of exploration wells to penetrate a target interval in a subterranean formation, wherein a wellbore fluid pressure is less than a formation fluid pressure to allow a fluid flow from the target interval to surface during a drilling phase of the UBD, determining, based on the UBD of the plurality of exploration wells, a measure of the fluid flow from the target interval to the surface, obtaining, based on the UBD of the plurality of exploration wells, open hole logs of the plurality of exploration wells, wherein the open hole logs represent a reservoir property of the target interval, and selectively performing, based at least on the measure of the fluid flow and the open hole logs, the DST of the plurality of exploration wells.

Other aspects and advantages will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1A:
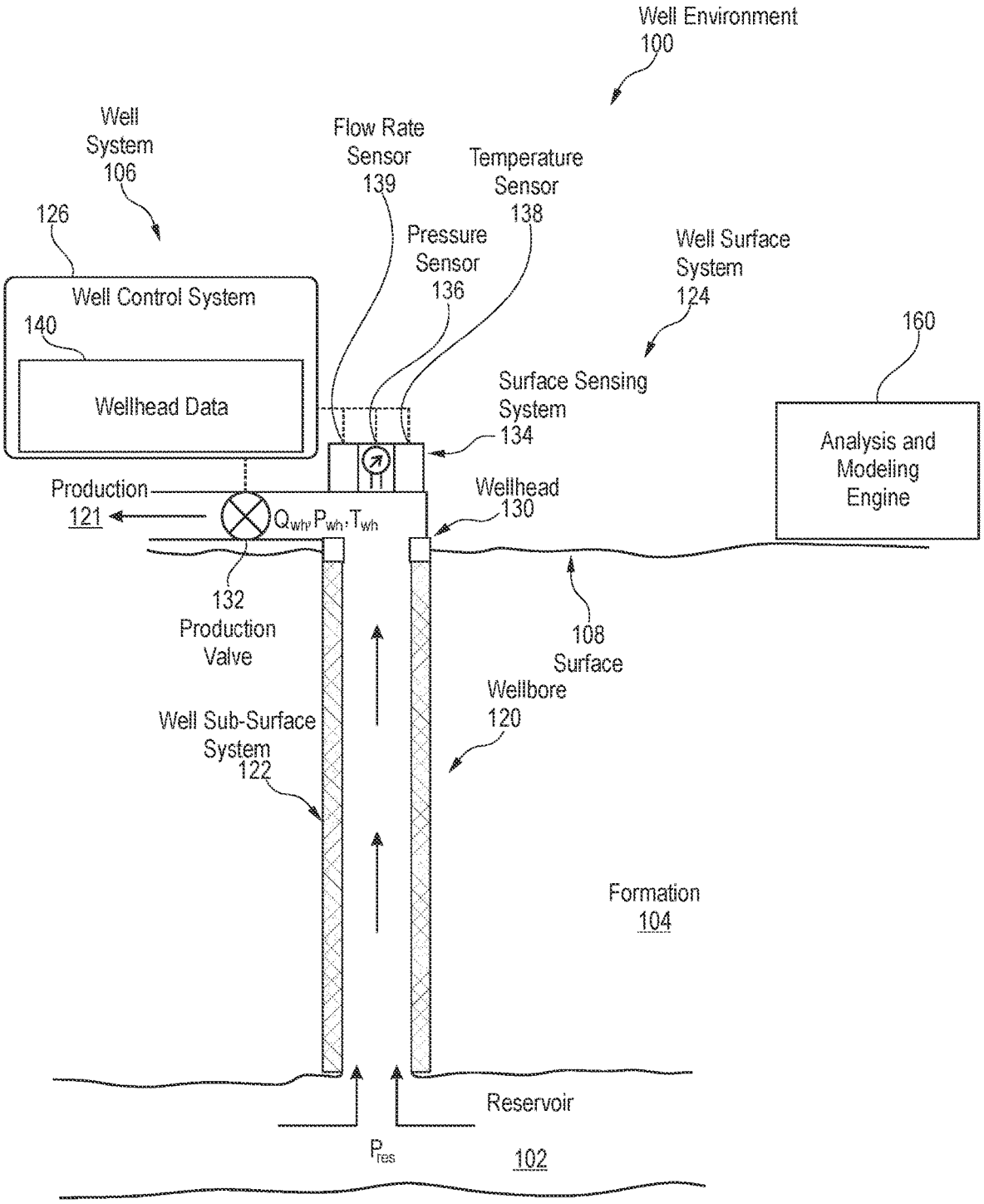
FIGS. 1A-1C show systems in accordance with one or more embodiments.

Specific embodiments of the disclosure will now be described in detail with reference to the accompanying figures. Like elements in the various figures are denoted by like reference numerals for consistency.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Embodiments of the invention provide a method, a system, and a non-transitory computer readable medium for performing drill stem tests (DSTs) of a reservoir. In one or more embodiments of the invention, test decisions regarding whether to perform DSTs for the reservoir are enhanced such that the number of unsuccessful DSTs are minimized or otherwise reduced. In particular, exploration wells are drilled using underbalanced drilling (UBD) to reach a target hydrocarbon zone to evaluate fluid flow to the surface and the hydrocarbon potential in the reservoir. During a drilling phase of the UBD, a wellbore fluid pressure is less than a formation fluid pressure to allow a fluid flow from the hydrocarbon zone to the surface. Drilling explorations wells using UBD minimizes reservoir damage by preventing mud invasion into the formation. In one or more embodiments of the invention, machine learning techniques are used to predict DST results of a new exploration well based on analyzing the UBD data of the new exploration well without actually performing the DSTs.

FIG. 1A shows a schematic diagram in accordance with one or more embodiments. More specifically, FIG. 1A illustrates a well environment (100) that includes a hydrocarbon reservoir ("reservoir") (102) located in a subsurface formation ("formation") (104) and a well system (106). The formation (104) may include a porous formation that resides underground, beneath the Earth's surface ("surface") (108). In the case of the well system (106) being a hydrocarbon well, the reservoir (102) may include a portion of the formation (104). The formation (104) and the reservoir (102) may include different layers (referred to as subterranean intervals or geological intervals) of rock having varying characteristics, such as varying degrees of permeability, porosity, capillary pressure, and resistivity. In other words, a subterranean interval is a layer of rock having consistent permeability, porosity, capillary pressure, resistivity, and/or other characteristics. In the case of the well system (106) being operated as a production well, the well system (106) may facilitate the extraction of hydrocarbons (or "production") from the reservoir (102).

In some embodiments, the well system (106) includes a wellbore (120), a well sub-surface system (122), a well surface system (124), and a well control system ("control system") (126). The control system (126) may control various operations of the well system (106), such as well production operations, well completion operations, well maintenance operations, and reservoir monitoring, assessment and development operations. In some embodiments, the control system (126) includes a computer system that is the same as or similar to that of computer system (400) described below in FIGS. 4A and 4B and the accompanying description.

The wellbore (120) may include a bored hole that extends from the surface (108) into a target zone (i.e., a subterranean interval) of the formation (104), such as the reservoir (102). An upper end of the wellbore (120), terminating at or near the surface (108), may be referred to as the "up-hole" end of the wellbore (120), and a lower end of the wellbore, terminating in the formation (104), may be referred to as the "down-hole" end of the wellbore (120). The wellbore (120) may facilitate the circulation of drilling fluids during drilling operations, the flow of hydrocarbon production ("production") (121) (e.g., oil and gas) from the reservoir (102) to the surface (108) during production operations, the injection of substances (e.g., water) into the formation (104) or the reservoir (102) during injection operations, or the communication of monitoring devices (e.g., logging tools) into the formation (104) or the reservoir (102) during monitoring operations (e.g., during in situ logging operations).

In some embodiments, during operation of the well system (106), the control system (126) collects and records wellhead data (140) for the well system (106). The wellhead data (140) may include, for example, a record of measurements of wellhead pressure ($P_{wh}$) (e.g., including flowing wellhead pressure), wellhead temperature ($T_{wh}$) (e.g., including flowing wellhead temperature), wellhead production rate ($Q_{wh}$) over some or all of the life of the well (106), and water cut data. In some embodiments, the measurements are recorded in real-time, and are available for review or use within seconds, minutes, or hours of the condition being sensed (e.g., the measurements are available within 1 hour of the condition being sensed). In such an embodiment, the wellhead data (140) may be referred to as "real-time" wellhead data (140). Real-time wellhead data (140) may enable an operator of the well (106) to assess a relatively current state of the well system (106), and make real-time decisions regarding development of the well system (106) and the reservoir (102), such as on-demand adjustments in regulation of production flow from the well.

In some embodiments, the well sub-surface system (122) includes casing installed in the wellbore (120). For example, the wellbore (120) may have a cased portion and an uncased (or "open-hole") portion. The cased portion may include a portion of the wellbore having casing (e.g., casing pipe and casing cement) disposed therein. The uncased portion may include a portion of the wellbore not having casing disposed therein. In embodiments having a casing, the casing defines a central passage that provides a conduit for the transport of tools and substances through the wellbore (120). For example, the central passage may provide a conduit for lowering logging tools into the wellbore (120), a conduit for the flow of production (121) (e.g., oil and gas) from the reservoir (102) to the surface (108), or a conduit for the flow of injection substances (e.g., water) from the surface (108) into the formation (104). In some embodiments, the well sub-surface system (122) includes production tubing installed in the wellbore (120). The production tubing may provide a conduit for the transport of tools and substances through the wellbore (120). The production tubing may, for example, be disposed inside casing. In such an embodiment, the production tubing may provide a conduit for some or all of the production (121) (e.g., oil and gas) passing through the wellbore (120) and the casing.

In some embodiments, the well surface system (124) includes a wellhead (130). The wellhead (130) may include a rigid structure installed at the "up-hole" end of the wellbore (120), at or near where the wellbore (120) terminates at the Earth's surface (108). The wellhead (130) may include structures (called "wellhead casing hanger" for casing and "tubing hanger" for production tubing) for supporting (or "hanging") casing and production tubing extending into the wellbore (120). Production (121) may flow through the wellhead (130), after exiting the wellbore (120) and the well sub-surface system (122), including, for example, the casing and the production tubing. In some embodiments, the well surface system (124) includes flow regulating devices that are operable to control the flow of substances into and out of the wellbore (120). For example, the well surface system (124) may include one or more production valves (132) that are operable to control the flow of production (121). For example, a production valve (132) may be fully opened to enable unrestricted flow of production (121) from the wellbore (120), the production valve (132) may be partially opened to partially restrict (or "throttle") the flow of production (121) from the wellbore (120), and production valve (132) may be fully closed to fully restrict (or "block") the flow of production (121) from the wellbore (120), and through the well surface system (124).

In some embodiments, the wellhead (130) includes a choke assembly. For example, the choke assembly may include hardware with functionality for opening and closing the fluid flow through pipes in the well system (106). Likewise, the choke assembly may include a pipe manifold that may lower the pressure of fluid traversing the wellhead. As such, the choke assembly may include set of high pressure valves and at least two chokes. These chokes may be fixed or adjustable or a mix of both. Redundancy may be provided so that if one choke has to be taken out of service, the flow can be directed through another choke. In some embodiments, pressure valves and chokes are communicatively coupled to the well control system (126). Accordingly, a well control system (126) may obtain wellhead data regarding the choke assembly as well as transmit one or more commands to components within the choke assembly in order to adjust one or more choke assembly parameters.

Keeping with FIG. 1A, in some embodiments, the well surface system (124) includes a surface sensing system (134). The surface sensing system (134) may include sensors for sensing characteristics of substances, including production (121), passing through or otherwise located in the well surface system (124). The characteristics may include, for example, pressure, temperature and flowrate of production (121) flowing through the wellhead (130), or other conduits of the well surface system (124), after exiting the wellbore (120).

In some embodiments, the surface sensing system (134) includes a surface pressure sensor (136) operable to sense the pressure of production (121) flowing through the well surface system (124), after it exits the wellbore (120). The surface pressure sensor (136) may include, for example, a wellhead pressure sensor that senses a pressure of production (121) flowing through or otherwise located in the wellhead (130). In some embodiments, the surface sensing system (134) includes a surface temperature sensor (138) operable to sense the temperature of production (121) flowing through the well surface system (124), after it exits the wellbore (120). The surface temperature sensor (138) may include, for example, a wellhead temperature sensor that senses a temperature of production (121) flowing through or otherwise located in the wellhead (130), referred to as "wellhead temperature" ($T_{wh}$). In some embodiments, the surface sensing system (134) includes a flowrate sensor (139) operable to sense the flowrate of production (121) flowing through the well surface system (124), after it exits the wellbore (120). The flowrate sensor (139) may include hardware that senses a flowrate of production (121) ($Q_{wh}$) passing through the wellhead (130).

Prior to completing the well system (106) or for identifying candidate locations to drill a new well, drill stem tests (DSTs) may be performed to evaluate the economic potential of completing the formation drilling by identifying productive capacity, pressure, permeability or extent of an oil or gas reservoir, such as the reservoir (102). In some embodiments, the well system (106) includes tools for performing DSTs as described in reference to FIG. 1B below. The well system (106) further includes an analysis and modeling engine (160). For example, the analysis and modeling engine (160) may include hardware and/or software with functionality to facilitate selectively performing DSTs of new or exploration wells in the formation (104). The analysis and modeling engine (160) may further include functionality for using machine learning techniques to predict DST results without actually performing the DST. While the analysis and modeling engine (160) is shown at a well site, embodiments are contemplated where reservoir and/or basin simulators are located away from well sites. In one or more embodiments of the invention, the analysis and modeling engine (160) may include a computer system that is similar to the computer system (400) described below with regard to FIGS. 4A and 4B and the accompanying description.

Figure 1B:
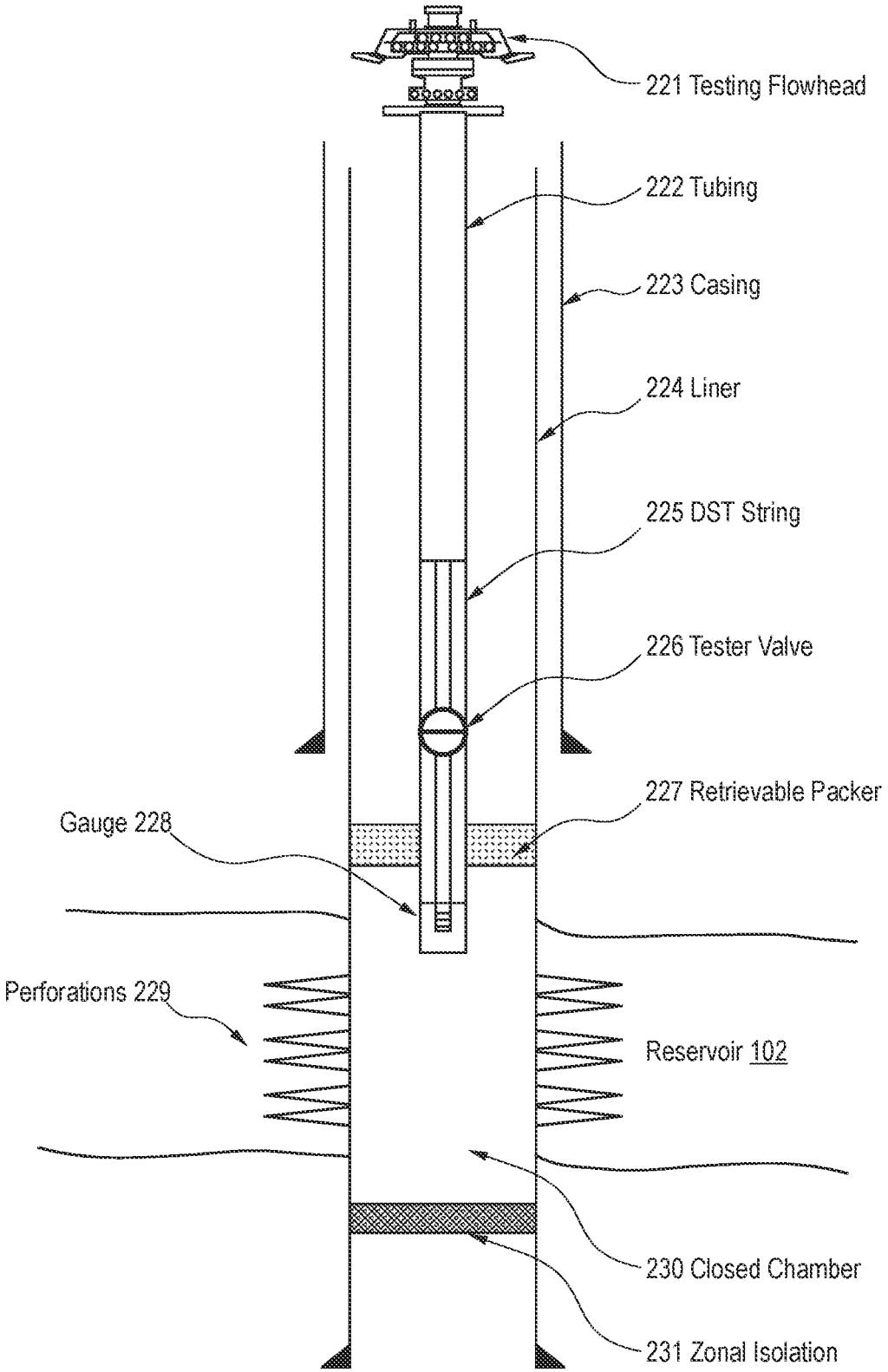

Turning to FIG. 1B, FIG. 1B shows a schematic diagram in accordance with one or more embodiments. Specifically, FIG. 1B illustrates details of the well system (106) depicted in FIG. 1A above for performing the drill stem test (DST). In one or more embodiments, one or more of the modules and/or elements shown in FIG. 1B may be omitted, repeated, and/or substituted. Accordingly, embodiments of the invention should not be considered limited to the specific arrangements of modules and/or elements shown in FIG. 1B.

As shown in FIG. 1B, the testing flowhead (221), casing (223), liner (224), and perforations (229) are part of the wellhead (130) and wellbore (120) depicted in FIG. 1A above. In one or more embodiments of the invention, the tubing (222) and DST string (225) are used to deploy a DST tool into the wellbore (120) to perform the DST. The DST tool includes the tester valve (226), gauge (228), and packers (i.e., retrievable packer (227), zonal isolation (231)). The DST is performed to determine the productive capacity, pressure, permeability, or extent of the hydrocarbon reservoir (102) depicted in FIG. 1A above. The DST tool is used to isolate the zone of interest (e.g., closed chamber (230)) with temporary packers. Next, one or more valves are opened to allow the reservoir fluids to flow through the DST string (225) and tubing (222) for a time period. Data obtained from the DST include one or more of fluid samples, reservoir pressure, formation properties (e.g., permeability, skin, and radius of investigation), flowrate, etc. After the DST, the operator closes the valves, removes the packers, and trips the DST bottomhole assembly out of the wellbore (120).

In one or more embodiments, the DST is performed during the drilling phase of the wellbore (120). A determination may be made to complete the drilling and completion of the wellbore (120) if the data obtained from the DST confirms that the productive capacity, pressure, permeability or extent of the reservoir (102) meet certain economic criteria. Otherwise, the drilling and completion of the wellbore (120) may be abandoned if the data obtained from the DST indicates that the productive capacity, pressure, permeability or extent of the reservoir (102) do not meet the economic criteria.

More specifically, the DST can be viewed as a temporary completion of the wellbore (120). The DST tool is run into the mud-filled wellbore (120) in order to isolate the target zone of interest (e.g., closed chamber (230)) from the surrounding zones, and a sequence of alternating production and shut-in phases is performed as a transient well test. The bottomhole pressure is continuously recorded by the gauge (228) as the DST starts with the opening of the bottom-hole tester valve (226), allowing the formation fluids to enter into the drill string (i.e., DST string (225), tubing (222)), which may be empty or partially filled with a liquid cushion. In some cases, the drill string may also contain pressurized gas. The first flow period is usually short, and the produced fluids do not reach the surface by the time of the shut-in of the wellbore (120). However, after the wellbore (120) is shut-in, a pressure recovery takes place in the reservoir (102), due to the fluid withdrawal during the production phase. Analysis of pressure-time data (also referred to as transient-pressure data) obtained during the transient well test, in combination with the fluid production or injection rates, and the rock and fluid properties, provides the initial reservoir pressure, and an estimate of the formation permeability and wellbore condition.

When a producing well is shut-in at surface, flow into the wellbore (120) at sandface (i.e., through perforations (229) or other interfaces between the wellbore (120) and the reservoir (102)) continues after shut-in. This type of flow regime is referred to as afterflow or wellbore storage.

In one or more embodiments, DSTs are selectively performed by drilling exploration wells using underbalanced drilling in order to evaluate the reservoir flow potential. If the exploration well flows, the DST equipment is deployed and the DST is performed for the flowing well. Otherwise, the DST equipment is not deployed and the DST is not performed for the non-flowing well. A method of selectively performing DSTs is described in reference to FIG. 2 below.

Figure 1C:
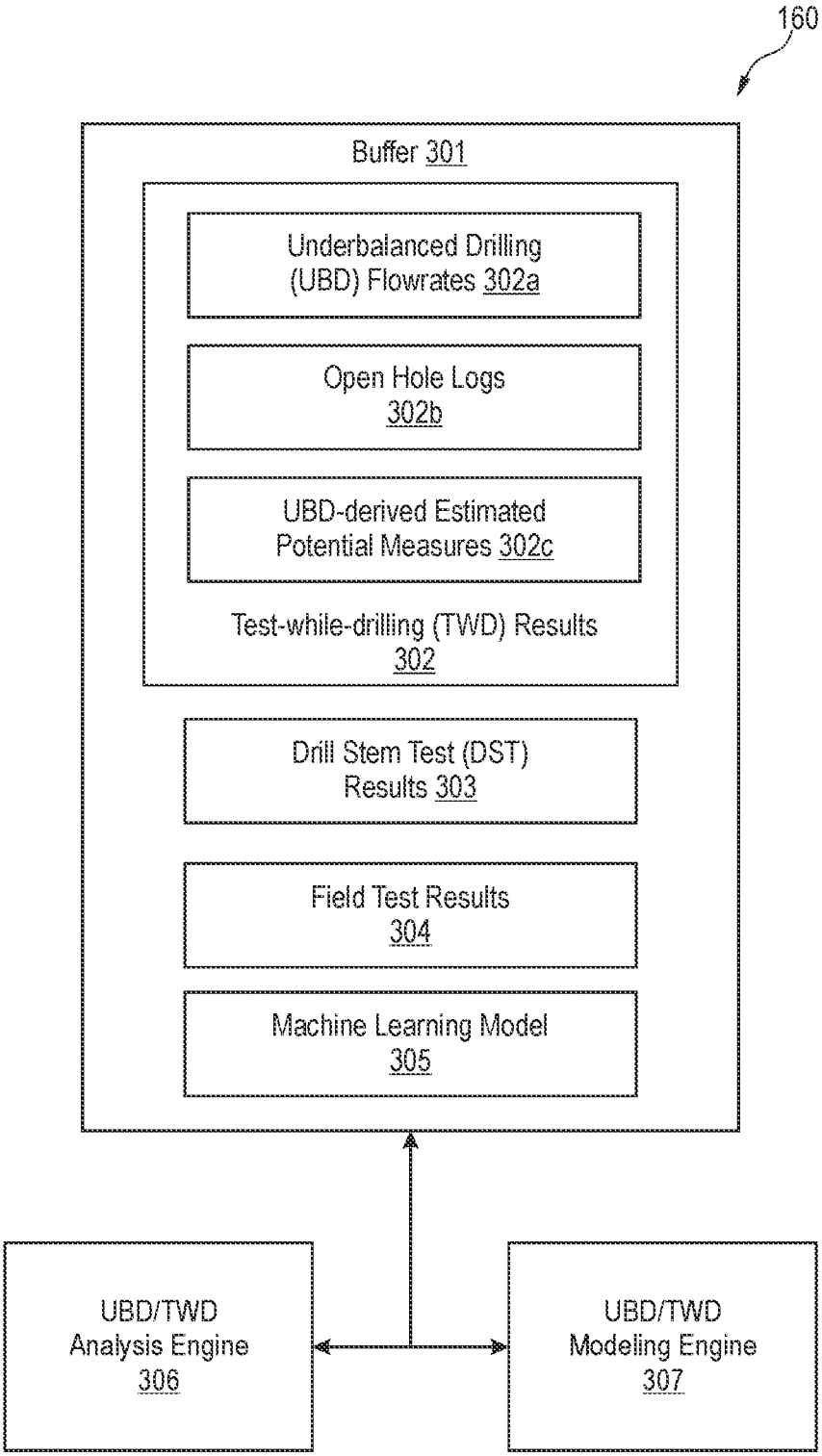

Turning to FIG. 1C. FIG. 1C shows a schematic diagram in accordance with one or more embodiments. Specifically. FIG. 1C illustrates details of the analysis engine (160) depicted in FIG. 1A above. In one or more embodiments, one or more of the modules and/or elements shown in FIG. 1C may be omitted, repeated, and/or substituted. Accordingly, embodiments of the invention should not be considered limited to the specific arrangements of modules and/or elements shown in FIG. 1C.

As shown in FIG. 1C, the analysis and modeling engine (160) has multiple components, including, for example, a buffer (301), a UBD/testing-while-drilling (TWD) analysis engine (306), and a UBD/TWD modelling engine (307). Each of these components (301, 306, 307) may be implemented in hardware (i.e., circuitry), software, or any combination thereof. Further, each of these components (301, 306, 307) may be located on the same computing device (e.g., personal computer (PC), laptop, tablet PC, smart phone, multifunction printer, kiosk, server, etc.) or on different computing devices connected by a network of any size having wired and/or wireless segments. In one or more embodiments, these components may be implemented using the computing system (400) described below in reference to FIGS. 4A and 4B. Each of these components is discussed below.

In one or more embodiments of the invention, the buffer (301) is configured to store TWD results (302), DST results (303), field test results (304), and a machine learning model (305). The TWD results (302) is collected data and corresponding analysis results during the underbalanced drilling of multiple exploration wells. Specifically, the TWD results (302) includes UBD flowrates (302*a*), open hole logs (302*b*), and UBD-derived estimated potential measures (302*c*). The UBD flowrates (302*a*) are flowrate measurements of fluid flows to the surface during the UBD of exploration wells. The open hole logs (302*b*) are data logs obtained using logging-while-drilling equipment during the UBD of exploration wells. The UBD-derived estimated potential measures (302*c*) are estimated hydrocarbon producing potential (i.e., reservoir production quality) of the target zones reached by the exploration wells as derived based on the UBD flowrates (302*a*), open hole logs (302*b*), and fluid samples obtained during the UBD of exploration wells. The DST results (303) are test results collected from DSTs of multiple exploration wells. For example, the DST results (303) may include estimated formation permeabilities and wellbore conditions derived from measurement data of the DST tools, as described in reference to FIG. 1B above. The field test results (304) are actual hydrocarbon producing quality and measurements of producing wells that are completed based on the TWD results (302) and DST results (303). The machine learning model (305) is a computing model generated using machine learning techniques based on correlations among the TWD results (302), DST results (303), and field test results (304).

In one or more embodiments of the invention, the UBD/TWD analysis engine (306) is configured to generate the UBD-derived estimated potential measures (302*c*) based on the UBD flowrates (302*a*), open hole logs (302*b*), and fluid samples obtained during the UBD of exploration wells. The UBD/TWD modelling engine (307) is configured to generate the machine learning model (305) based on the TWD results (302), DST results (303), and field test results (304). In one or more embodiments, the UBD/TWD analysis engine (306) and the UBD/TWD modelling engine (307) perform the functions described above using the method workflow described in reference to FIG. 2 below. An example of performing the method workflow using the UBD/TWD analysis engine (306) and the UBD/TWD modelling engine (307) is described in reference to FIGS. 3A-3C below.

Although the analysis and modeling engine (160) is shown as having three components (301, 306, 307), in one or more embodiments of the invention, the analysis and modeling engine (160) may have more or fewer components. Furthermore, the functions of each component described above may be split across components or combined in a single component. Further still, each component (301, 306, 307) may be utilized multiple times to carry out an iterative operation.

Figure 2:
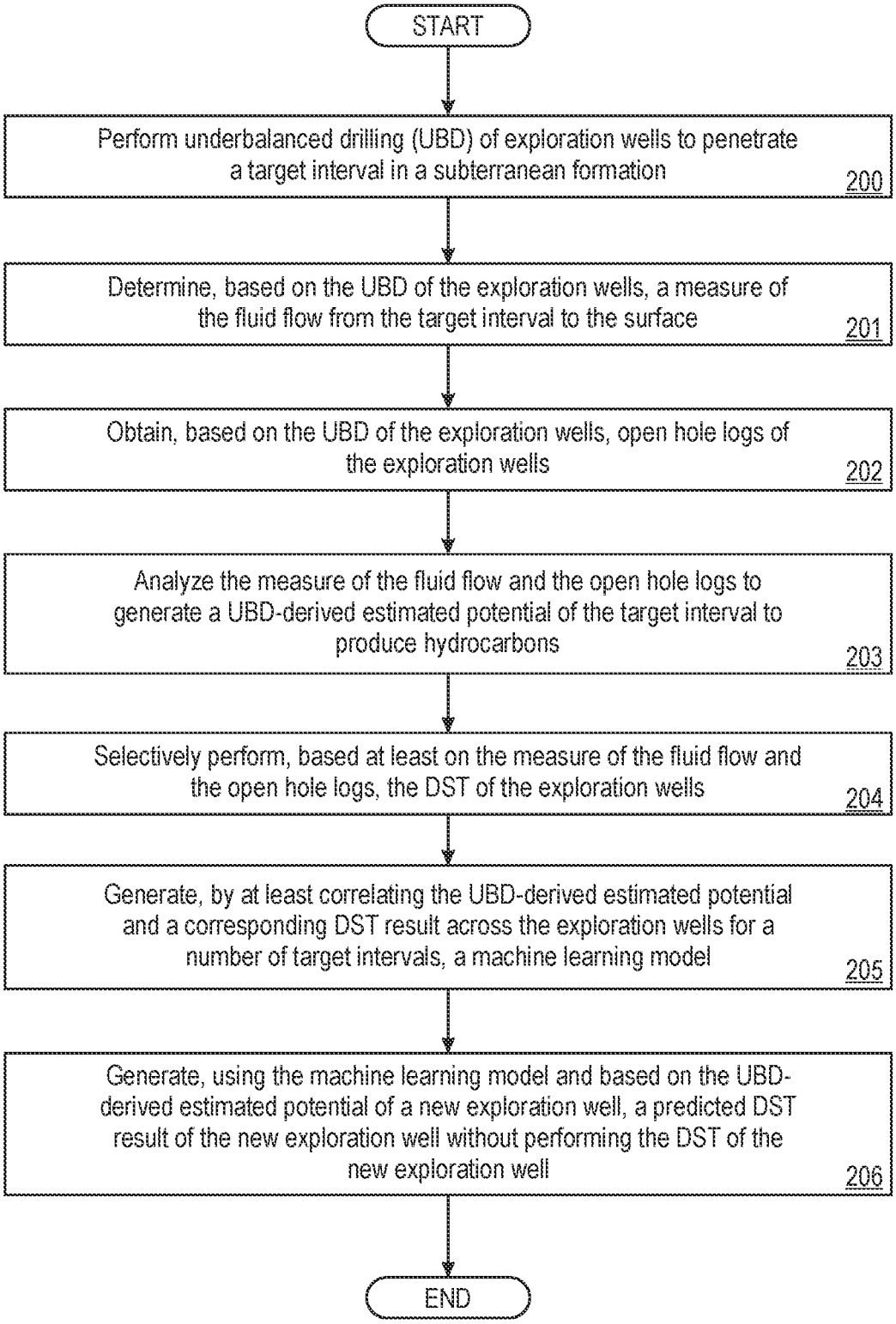
FIG. 2 shows a flowchart in accordance with one or more embodiments.

FIG. 2 shows a flowchart in accordance with one or more embodiments. One or more blocks in FIG. 2 may be performed using one or more components as described in FIGS. 1A-IC. While the various blocks in FIG. 2 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially in Block 200, underbalanced drilling (UBD) of a number of exploration wells is performed to penetrate a target interval (i.e., a subterranean interval referred to as the first target interval) in a subterranean formation. As noted above, during a drilling phase of the UBD, a wellbore fluid pressure is less than a formation fluid pressure to allow a fluid flow from the first target interval to the surface.

In Block 201, based on the UBD of the exploration wells, a measure of the fluid flow from the first target interval to the surface is determined. In one or more embodiments, the measure of the fluid flow includes a fluid flowrate that is measured using a multi-phase flow meter. For example, the fluid flow measure may includes an oil flowrate and a gas flowrate.

In Block 202, based on the UBD of the exploration wells, open hole logs of the exploration wells are obtained using a logging-while-drilling tool. In particular, the open hole logs represent a reservoir property (referred to as the first reservoir property) of the first target interval. For example, the reservoir property may include pressure, permeability, and other productive capacity indicators.

In Block 203, the measure of the fluid flow and the open bole logs are analyzed to generate a UBD-derived estimated potential of the first target interval to produce hydrocarbons. For example, the UBD-derived estimated potential may correspond to a combination of the fluid flowrate and the pressure, permeability, and other productive capacity indicators. As noted above, the UBD-derived estimated potential is an estimated measure of the reservoir production quality, and may be computed as a ratio, a percentage, a number, a letter grade, or other suitable formats.

In Block 204, based at least on the UBD-derived estimated potential, the DST of the exploration wells is selectively performed. For an exploration well (referred to as the first exploration well) having the UBD-derived estimated potential meeting a pre-determined criterion, the DST of the first exploration well is performed for the first target interval.

For example, the pre-determined criterion may require that the fluid flowrate from the first target interval to the surface exceeds a minimum flowrate and that the first reservoir property showing the pressure, permeability, and other productive capacity indicators reaching respective minimum levels. For example, the pre-determined criterion may include 5 million standard cubic feet per day (MMSCFD) with 2 milli-Darcy (mD) permeability and 10% porosity in a DST. In this context, the first exploration well is designated as a flowing well. In contrast, for another exploration well (referred to as the second exploration well) having the UBD-derived estimated potential failing to meet the pre-determined criterion, the second exploration well is eliminated from performing the DST for the first target interval. In contrast to the first exploration well, the second exploration well is designated as a non-flowing well.

The UBD of the second exploration well may be continued to penetrate a deeper target interval (i.e., a subterranean interval referred to as the second target interval) beneath at least the first target interval. Similar to the above procedure, based on the continued UBD of the second exploration well, the UBD-derived estimated potential of the second target interval to produce hydrocarbons through the second exploration well is determined. Accordingly, the DST of the second exploration well for the second target interval is selectively performed based at least on the UBD-derived estimated potential of the second target interval to produce hydrocarbons through the second exploration well. In other words, the DST of the second exploration well for the second target interval may be performed if such UBD-derived estimated potential meets the pre-determined criterion described above. Otherwise, the second exploration well may again be eliminated from performing the DST for the second target interval if such UBD-derived estimated potential fails to meet the pre-determined criterion described above.

Additionally, a fluid sample of the first target interval may be obtained from the fluid flow to the surface where a multi-phase separator device is used to separate the fluid sample into at least an oil sample and a gas sample. In one or more embodiments, the UBD-derived estimated potential described above may be augmented as a combination of the fluid flowrate, pressure, permeability, and other productive capacity indicators described above, as well as certain oil property and gas property measured from the oil and gas samples of the separator device. The reservoir fluid properties in the first exploration well and the second exploration well should be similar to confirm they are producing from the same reservoir.

In Block 205, a machine learning model for predicting DST results is generated. In one or more embodiments, the UBD-derived estimated potential and the corresponding DST result described above for both flowing wells and non-flowing wells are accumulated across a large number of exploration wells for multiple target intervals to form a machine learning training dataset. The machine learning model is generated by identifying correlations in the machine learning training dataset using machine learning algorithms, such as supervised learning or unsupervised learning based on linear regression, logistic regression, decision tree, naive bayes, k-means, random forest, dimensionality reduction algorithms, etc.

In Block 206, the UBD-derived estimated potential of a new exploration well (referred to as the third exploration well) is used to predict the DST result using a machine learning technique based on the machine learning model generated in Block 205 above. In one or more embodiments, the third exploration well is separate from those exploration wells included in the machine learning training dataset. The predicted DST result of the third exploration well is generated without performing the DST of the third exploration well.

Figure 3A:
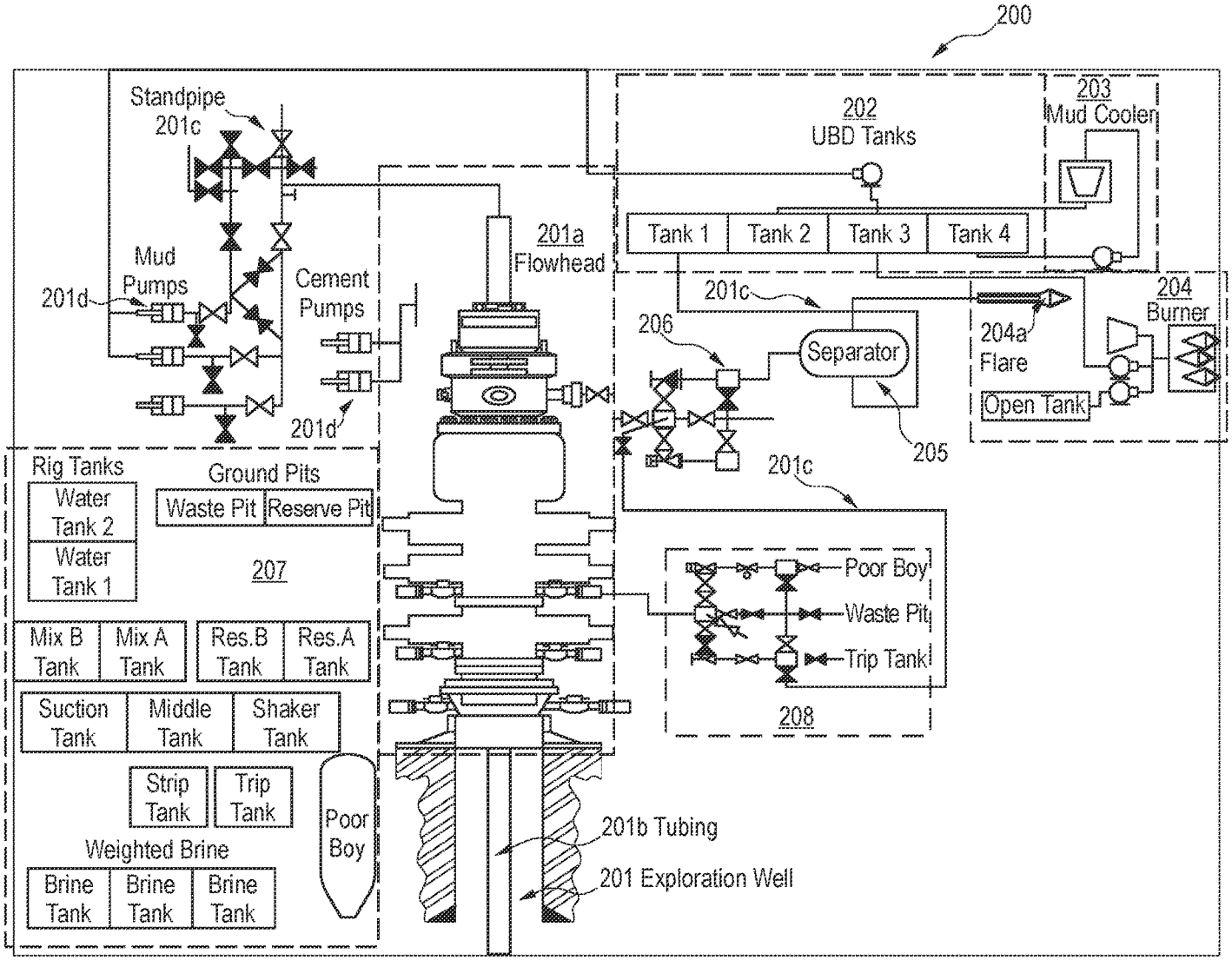
FIGS. 3A-3C show an example in accordance with one or more embodiments.
Figure 3B:
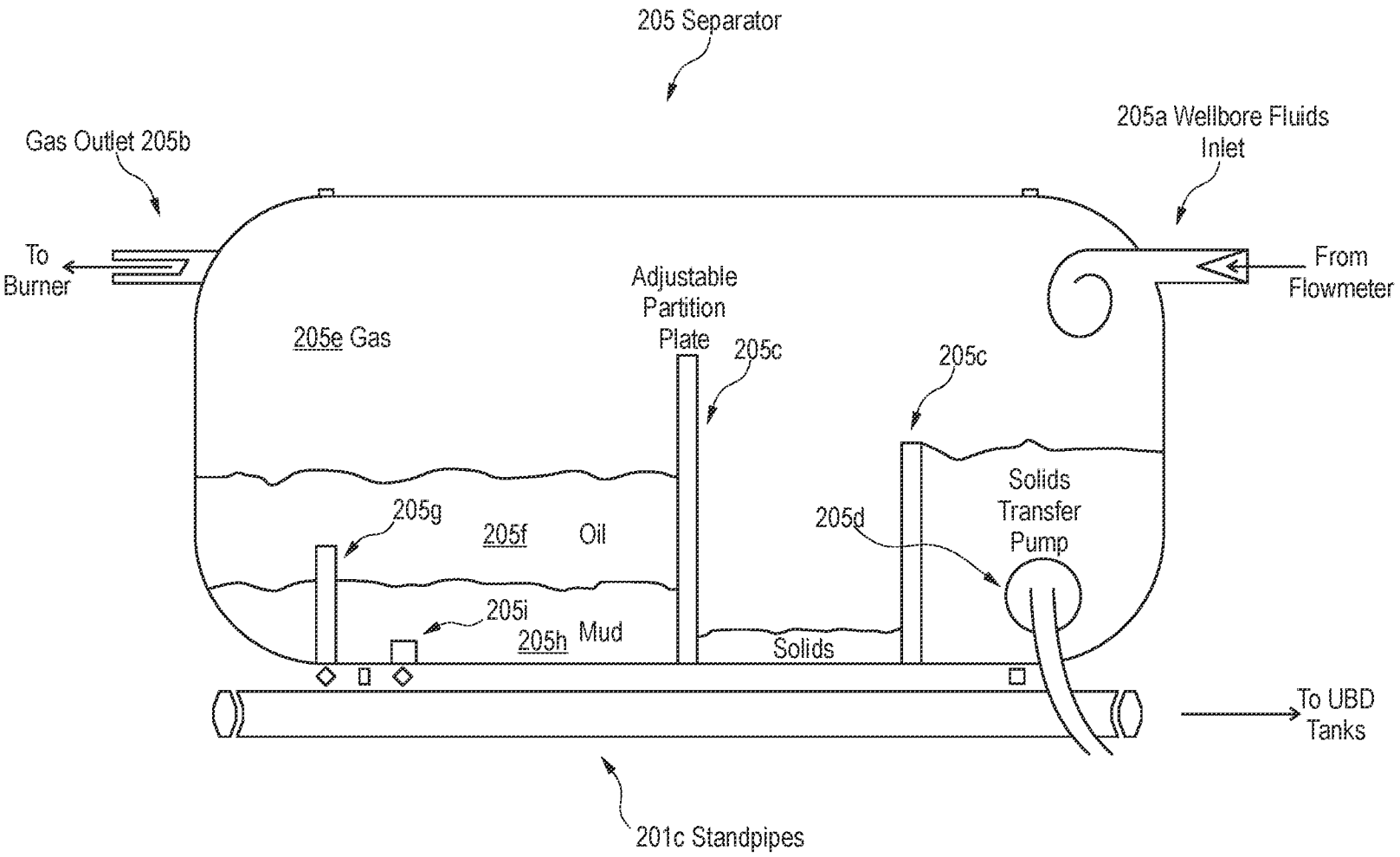
Figure 3C:
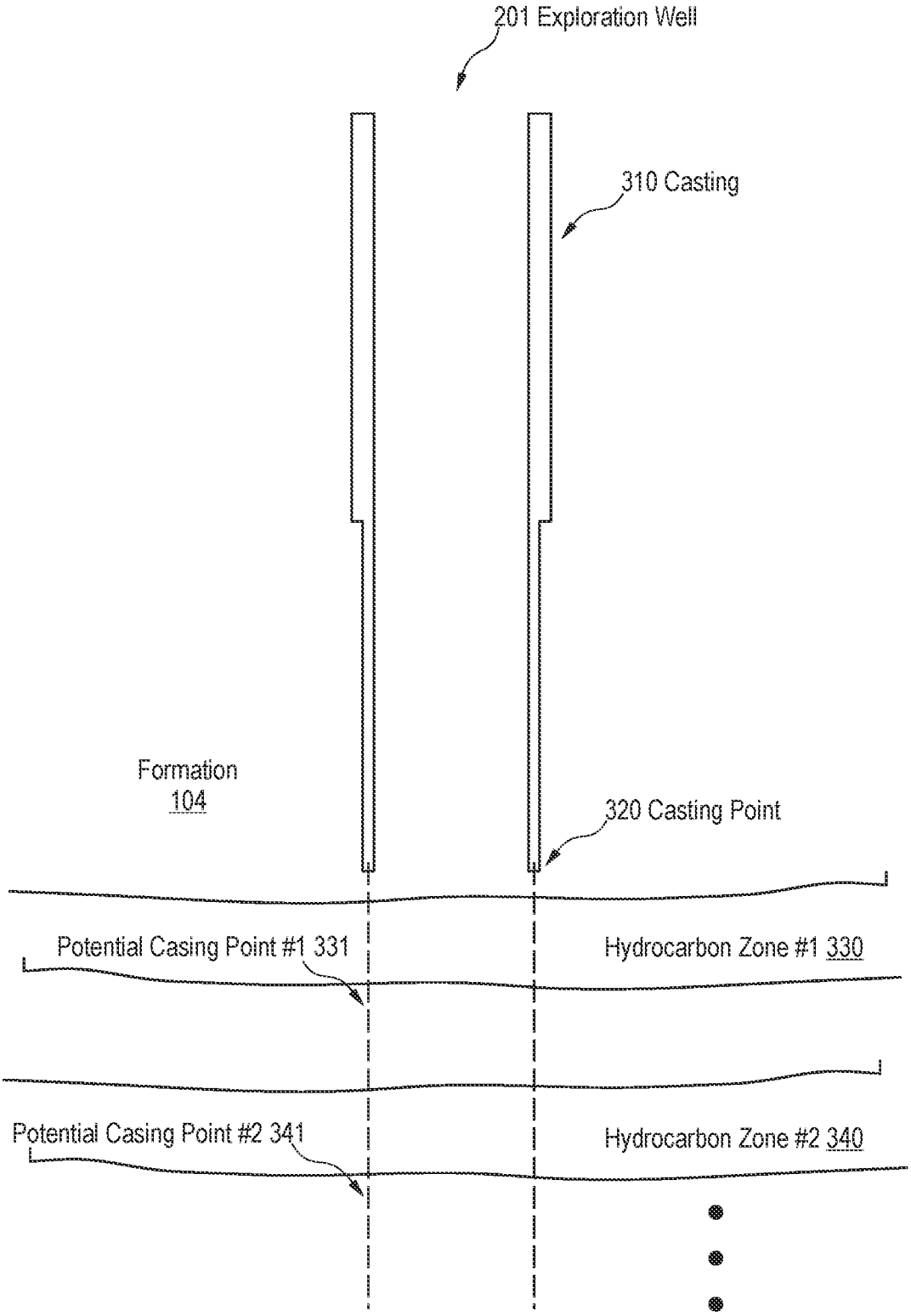

FIGS. 3A-3C show an example in accordance with one or more embodiments. The example shown in FIGS. 3A-3C is based on the system and method described in reference to FIGS. 1A-1C and 2 above. The example shown in FIGS. 3A-3C relates to underbalanced drilling of exploration wells for the targeted hydrocarbon reservoir in order to evaluate the reservoir flow potential. As noted above, the drill stem test (DST) is a procedure for isolating and testing the pressure, permeability, and productive capacity of a geological formation during the drilling of a well. DST is an important measurement of pressure behavior at the drill stem and is a valuable way of obtaining information on the formation fluid and establishing whether a well reaches a commercially viable hydrocarbon reservoir. Normally, the decision to perform a DST is based on open hole logs including fluid sampling. However, not all DSTs are successful where hydrocarbon zone (i.e., a subterranean interval containing hydrocarbons) flows commercially viable amount of oil and gas. Some DST ends up dry, meaning no hydrocarbon flows to surface. The example shown in FIGS. 3A-3C enhances the reservoir test decision making and minimizes the number of unsuccessful DSTs to reduce the expensive well testing operations, such as running and cementing liner/casing, deploying well testing downhole tools and related equipment, etc.

FIG. 3A shows a surface layout of a well logging system (200) for performing testing-while-drilling (TWD) of a underbalanced drilling (UBD) of an exploration well (201). As noted above, the UBD is the act of drilling a well with the wellbore fluid gradient (e.g., pressure gradient) less than the natural formation gradient. Because the lower wellbore fluid gradient results in lower hydrostatic pressure in the wellbore, the formation fluids can enter the wellbore to flow up to the surface. Therefore, the UBD permits the exploration well (201) to flow while the TWD proceeds. Specifically, the TWD is the act of (i) checking whether the exploration well (201) flows hydrocarbon or not during the UBD drilling phase and (ii) recording open hole logs to evaluate the reservoir potential. Besides minimizing lost circulation and increasing the penetration rate, the UBD minimizes the damage caused by invasion of drilling fluid (i.e., mud) into the formation. The well logging system (200) is an example of the well surface system (124) depicted in FIG. 1A above. As shown in FIG. 3A, the well logging system (200) includes a flowhead (201*a*) with associated tubing (201*b*), standpipes (201*c*), pumps (201*d*), multiple UBD tanks (202), a mud cooler (203), a burner (204), a separator (205), an UBD choke manifold (206), and various rig tanks and ground pits (207) with associated routing network (208). In the routing network (208), "Poor Boy" denotes a degasser or mud gas separator, located downstream of the choke manifold, which is a vertical vessel used to separate any gas from drilling fluid during well control situation. Once the gas has been separated, it can pass through the vent line in the derrick. Alternatively, as long as it's a safe distance from the rig, it could even be vented. In addition, "Trip Tank" is a small tank which has a capacity of 20-50 barrels (bbl) with a shape that is tall and shallow because it can effectively detect volume changes. The trip tank system has the ability to continuously fill the well and take return back to the tank. With this capability, it will keep the bole full all the time and the volume changes either increasing or decreasing can tell the condition of the well.

The flowhead (201*a*) and tubing (201*b*) correspond to the testing flowhead (221) and tubing (222) depicted in FIG. 1B above. The standpipes (201*c*) are flow lines installed on the surface. The separator (205) is a mud, oil, and gas separator that is connected to the standpipes (201*c*) to receive wellbore fluids from the flowhead (201*a*) via the UBD choke manifold (206), send the separated gas to the burner (204) to be burned as the flare (204*a*), and return the separated mud back to the UBD tanks (202). The flow line from the separator (205) to the UBD choke manifold (206) is equipped with a three-phase flowmeter to measure oil and gas flowrates during the UBD (referred to as the UBD flowrates). That is, in one or more embodiments, three-phase flowmeter may be disposed just before the separator (205). Additional details of the separator (205) is described in reference to FIG. 3B below.

By way of the well logging system (200), drilling a target interval in the formation using UBD gives the well an advantageous environment to flow while observing the reservoir potential. If the target interval of the reservoir flows hydrocarbon during the UBD drilling phase and the open hole logs show good reservoir potential and quality, a decision is then made to perform a DST of the exploration well (201) for acquiring more accurate data of the target interval. Otherwise, no DST of the exploration well (201) is initiated for the target interval. Using the combined criteria based on the UBD flowrates and the open hole logs acquired during the UBD, non-flowing reservoirs are eliminated during the TWD phase before any expensive DST is initiated.

FIG. 3B shows further details of the separator (205) depicted in FIG. 3A above. As shown in FIG. 3B, the separator (205) includes a wellbore fluids inlet (205*a*), a gas outlet (205*b*), adjustable partition plates (205*c*), and a solids transfer pump (205*d*). Once the target interval in the reservoir shows positive signs for flow based on the aforementioned three-phase flowmeter, the wellbore fluids coming from the exploration well (201) is routed through the flow line (i.e., standpipes (201*c*)) to the separator (205). The received wellbore fluids are separated by way of the adjustable partition plates (205*c*) into separated gas (205*e*), separated oil (205*f*), and separated mud (205*h*). The separated mud (205*h*) is sent back to the circulating system via the mud outlet (205*i*), the separate oil (205*f*) is sent to test tanks (i.e. UBD tanks (202)) via the oil outlet (205*g*), and the separated gas (20*c*) is sent to the burner (204) via the gas outlet (205*b*). Properties of the wellbore fluids can be measured by taking samples from the test tank for the separated oil (205*f*) and through a needle valve for the separated gas (205*e*) once they leave the separator (205). Moreover, the well logging system (200) is equipped with a surface backpressure valve (not shown) to perform well shut in to measure the reservoir's final build up pressure. In the DST operation, after the final flowback period, a final pressure buildup is normally performed to see when the reservoir pressure will reach its final value and remain constant. This depends on the reservoir permeability and may take 12-48 hrs. This option is still available with TWD.

FIG. 3C shows an example casing design of the exploration well (201) where logging-while-drilling tool can be used in the drill string to evaluate fluid type and to identify flowing intervals in the formation (104). As shown in FIG. 3C, a casing (310) reaches a casing point (320) above a hydrocarbon zone #1 (330) where the section length of the casing (310) is limited to penetrate one hydrocarbon zone (i.e., a subterranean interval containing hydrocarbons) at a time. In other words, each time an additional section is added to the casing (310), at most one more hydrocarbon zone is penetrated by way of the additional section.

After completing and stopping the UBD of the hydrocarbon zone #1 (330), UBD flowrates are recorded, and the reservoir is stimulated by pumping nitrogen through the mud (i.e., drilling fluid) to increase the underbalance by reducing the mud density and, therefore, hydrostatic pressure of the wellbore fluids. If the exploration well (201) flows (i.e., the UBD flowrates exceed a preset threshold) when the UBD reaches the hydrocarbon zone #1 (330), wellbore fluid samples are retrieved and open hole logs are acquired. If the hydrocarbon zone #1 (330) is determined as a good candidate for DST based on the wellbore fluid samples and the open hole logs, the casing (310) is extended to the potential casing point #1 (331) and cemented for DST. Otherwise if the exploration well (201) does not flow from the hydrocarbon zone #1 (330) or if the hydrocarbon zone #1 (330) is determined as not a good candidate for DST based on the wellbore fluid samples and the open hole logs, the UBD is continued to reach the next target interval (i.e., hydrocarbon zone #2 (340)) where the same procedure is repeated. Specifically, if the exploration well (201) flows from the hydrocarbon zone #2 (340), additional wellbore fluid samples are retrieved and additional open hole logs are acquired for the hydrocarbon zone #2 (340). If the hydrocarbon zone #2 (340) is determined as a good candidate for DST based on the additional wellbore fluid samples and the additional open hole logs, the casing (310) is further extended to the potential casing point #2 (341) and cemented for DST. Otherwise if the exploration well (201) still does not flow from the hydrocarbon zone #2 (340) or if the hydrocarbon zone #2 (340) is also determined as not a good candidate for DST based on the additional wellbore fluid samples and the additional open hole logs, the UBD may be further continued to reach the next target interval (e.g., hydrocarbon zone #3 (not shown)) where the same procedure is one more repeated. Alternatively, at this point, if a predefined number of hydrocarbon zones have been determined as not good candidates for DST, the UBD may be terminated and the reservoir declared as commercially non-viable.

In other words, no DST is initiated for the hydrocarbon zone unless the combined criteria based on the UBD flowrates, open hole logs, and wellbore fluid samples are met. Accordingly, unproductive DSTs are avoided to reduce operation expenses and retain reservoir quality since there is no mud invasion to the formation occurs from unproductive DSTs.

As noted above, machine learning and artificial intelligence may be applied to the TWD results acquired from UBD operations of a large number of exploration wells. Once enough of a machine learning dataset is established based on the TWD results and corresponding DST results as well as field test results, the DST results can be predicted based on the TWD results prior to initiating the DST. Thus, unproductive DSTs are eliminated and the DST success rate is increased.

Figure 4A:
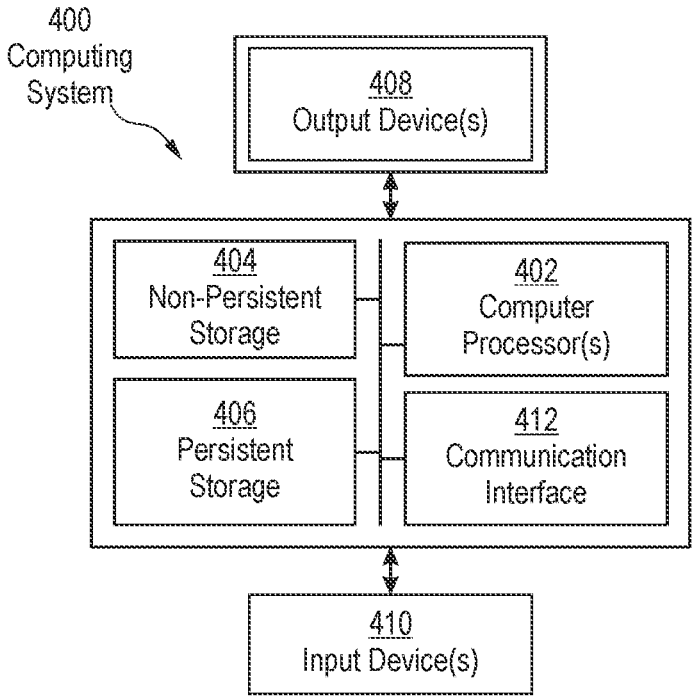
FIGS. 4A and 4B show a computing system in accordance with one or more embodiments.

Embodiments disclosed herein may be implemented on a computing system. Any combination of mobile device, desktop, server, router, switch, embedded device, or other types of hardware may be used. For example, the UBD/TWD analysis engine (306) and UBD/TWD modeling engine (307) depicted in FIG. 1C above may be implemented using computer processors and software instructions of such computing system to analyze and generate the aforementioned TWD results, DST results, and machine learning model. Similarly, various stored data in the buffer (301) depicted in FIG. 1C above may be implemented using persistent and/or non-persistent storages of such computing system. Further, the UBD/TWD analysis engine and UBD/TWD modeling engine may receive inputs from and send control signals/commands to the well control system (126) and/or other part of the well system (106) depicted in FIG. 1A above using the communication interface of such computing system. As shown in FIG. 4A, the computing system (400) may include one or more computer processors (402), non-persistent storage (404) (e.g., volatile memory, such as random access memory (RAM), cache memory), persistent storage (406) (e.g., a hard disk, an optical drive such as a compact disk (CD) drive or digital versatile disk (DVD) drive, a flash memory, etc.), a communication interface (412) (e.g., Bluetooth interface, infrared interface, network interface, optical interface, etc.), and numerous other elements and functionalities.

The computer processor(s) (402) may be an integrated circuit for processing instructions. For example, the computer processor(s) may be one or more cores or micro-cores of a processor. The computing system (400) may also include one or more input devices (410), such as a touchscreen, keyboard, mouse, microphone, touchpad, electronic pen, or any other type of input device.

The communication interface (412) may include an integrated circuit for connecting the computing system (400) to a network (not shown) (e.g., a local area network (LAN), a wide area network (WAN) such as the Internet, mobile network, or any other type of network) and/or to another device, such as another computing device.

Further, the computing system (400) may include one or more output devices (408), such as a screen (e.g., a liquid crystal display (LCD), a plasma display, touchscreen, cathode ray tube (CRT) monitor, projector, or other display device), a printer, external storage, or any other output device. One or more of the output devices may be the same or different from the input device(s). The input and output device(s) may be locally or remotely connected to the computer processor(s) (402), non-persistent storage (404), and persistent storage (406). Many different types of computing systems exist, and the aforementioned input and output device(s) may take other forms.

Software instructions in the form of computer readable program code to perform embodiments of the disclosure may be stored, in whole or in part, temporarily or permanently, on a non-transitory computer readable medium such as a CD. DVD, storage device, a diskette, a tape, flash memory, physical memory, or any other computer readable storage medium. Specifically, the software instructions may correspond to computer readable program code that, when executed by a processor(s), is configured to perform one or more embodiments of the disclosure.

Figure 4B:
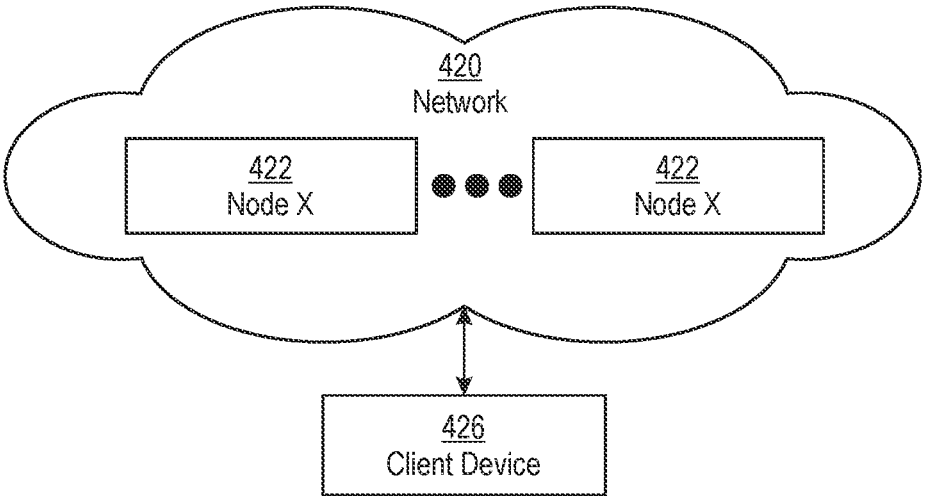

The computing system (400) in FIG. 4A may be connected to or be a part of a network. For example, as shown in FIG. 4B, the network (420) may include multiple nodes (e.g., node X (422), node Y (424)). Each node may correspond to a computing system, such as the computing system shown in FIG. 4A, or a group of nodes combined may correspond to the computing system shown in FIG. 4A. By way of an example, embodiments of the disclosure may be implemented on a node of a distributed system that is connected to other nodes. By way of another example, embodiments of the disclosure may be implemented on a distributed computing system having multiple nodes, where each portion of the disclosure may be located on a different node within the distributed computing system. Further, one or more elements of the aforementioned computing system (400) may be located at a remote location and connected to the other elements over a network.

Although not shown in FIG. 4B, the node may correspond to a blade in a server chassis that is connected to other nodes via a backplane. By way of another example, the node may correspond to a server in a data center. By way of another example, the node may correspond to a computer processor or micro-core of a computer processor with shared memory and/or resources.

The nodes (for example, node X (422), node Y (424)) in the network (420) may be configured to provide services for a client device (426). For example, the nodes may be part of a cloud computing system. The nodes may include functionality to receive requests from the client device (426) and transmit responses to the client device (426). The client device (426) may be a computing system, such as the computing system shown in FIG. 4A. Further, the client device (426) may include or perform all or a portion of one or more embodiments of the disclosure.

While the disclosure has been described with respect to a limited number of embodiments, those skilled in the art, having benefit of this disclosure, will appreciate that other embodiments can be devised which do not depart from the scope of the disclosure as disclosed herein. Accordingly, the scope of the disclosure should be limited only by the attached claims.

What is claimed is:

1. A method for performing a drill stem test (DST), comprising:

performing underbalanced drilling (UBD) of a plurality of exploration wells to penetrate a first target interval in a subterranean formation, wherein UBD is performed when a wellbore fluid pressure is less than a formation fluid pressure to allow a fluid flow from the first target interval to surface during a drilling phase of the UBD;

determining, based on the UBD of the plurality of exploration wells, a measure of the fluid flow from the first target interval to the surface;

obtaining, based on the UBD of the plurality of exploration wells, open hole logs of the plurality of exploration wells, wherein the open hole logs represent a first reservoir property of the first target interval;

analyzing the measure of the fluid flow and the open hole logs to generate a UBD-derived estimated potential of the first target interval to produce hydrocarbons;

selectively performing, based at least on the measure of the fluid flow and the open hole logs, the DST of the plurality of exploration well;

generating, by at least correlating the UBD-derived estimated potential and a corresponding DST result across the plurality of exploration wells for a plurality of target intervals, a machine learning model; and generating, using the machine learning model and based on the UBD-derived estimated potential of an additional exploration well separate from the plurality of the exploration wells, a predicted DST result of the additional exploration well, wherein the predicted DST result of the additional exploration well is generated without performing the DST of the additional exploration well.

2. The method of claim 1, further comprising:

wherein selectively performing the DST is based at least on the UBD-derived estimated potential.

3. The method of claim 2, wherein selectively performing the DST comprises:

performing, in response to the UBD-derived estimated potential of a first exploration well of the plurality of exploration wells meeting a pre-determined criterion, the DST of the first exploration well for the first target interval; and eliminating, in response to the UBD-derived estimated potential of a second exploration well of the plurality of exploration wells failing to meet the pre-determined criterion, the second exploration well from performing the DST for the first target interval, wherein the measure of the fluid flow comprises a fluid flowrate, and wherein the second exploration well is designated as a non-flowing well for the first target interval.

4. The method of claim 3, wherein selectively performing the DST further comprises:

performing, further in response to the estimated potential of the second exploration well failing to meet the pre-determined criterion, the UBD of the second exploration well to penetrate a second target interval beneath at least the first target interval;

determining, based on the UBD of the second exploration well, the measure of the fluid flow of the second exploration well from the second target interval to the surface;

obtaining, based on the UBD of the second exploration well, an open hole log of the second exploration well to represent a second reservoir property of the second target interval; and selectively performing, based at least on the measure of the fluid flow of the second exploration well and the open hole log of the second exploration well, the DST of the second exploration well for the second target interval.

5. The method of claim 1, further comprising:

obtaining a fluid sample of the first target interval from the fluid flow to the surface; and analyzing the fluid sample to determine a second reservoir property of the first target interval, wherein selectively performing the DST is further based on the second reservoir property of the first target interval.

6. The method of claim 5, further comprising:

separating, using a multi-phase separator device, the fluid sample into at least an oil sample and a gas sample, wherein analyzing the fluid sample comprises analyzing the oil sample and analyzing the gas sample, and wherein the second reservoir property comprises an oil property and a gas property of the first target interval.

7. A well system for performing a drill stem test (DST), the system comprising:

a drill string for performing underbalanced drilling (UBD) of each of a plurality of exploration wells to penetrate a first target interval in a subterranean formation, wherein a wellbore fluid pressure is less than a formation fluid pressure to allow a fluid flow from the first target interval to surface during a drilling phase of the UBD;

a multi-phase flow meter for determining, based on the UBD of each of the plurality of exploration wells, a measure of the fluid flow from the first target interval to the surface;

a testing-while-drilling tool for obtaining, based on the UBD of each of the plurality of exploration wells, open hole logs of the plurality of exploration wells, wherein the open hole logs represent a first reservoir property of the first target interval;

a DST tool for selectively performing, based at least on the measure of the fluid flow and the open hole logs, the DST of the plurality of exploration wells; and a memory and a computer processor connected to the memory that:

analyzes the measure of the fluid flow and the open hole logs to generate a UBD-derived estimated potential of the first target interval to produce hydrocarbons;

generates, by at least correlating the UBD-derived estimated potential and a corresponding DST result across the plurality of exploration wells for a plurality of target intervals, a machine learning model; and generates, using the machine learning model and based on the UBD-derived estimated potential of an additional exploration well separate from the plurality of the exploration wells, a predicted DST result of the additional exploration well, wherein the predicted DST result of the additional exploration well is generated without performing the DST of the additional exploration well.

8. The system of claim 7, wherein selectively performing the DST is based at least on the UBD-derived estimated potential.

9. The system of claim 8, wherein selectively performing the DST comprises:

performing, in response to the UBD-derived estimated potential of a first exploration well of the plurality of exploration wells meeting a pre-determined criterion, the DST of the first exploration well for the first target interval; and eliminating, in response to the UBD-derived estimated potential of a second exploration well of the plurality of exploration wells failing to meet the pre-determined criterion, the second exploration well from performing the DST for the first target interval, wherein the measure of the fluid flow comprises a fluid flowrate, and wherein the second exploration well is designated as a non-flowing well for the first target interval.

10. The system of claim 9, wherein selectively performing the DST further comprises:

performing, further in response to the estimated potential of the second exploration well failing to meet the pre-determined criterion, the UBD of the second exploration well to penetrate a second target interval beneath at least the first target interval;

determining, based on the UBD of the second exploration well, the measure of the fluid flow of the second exploration well from the second target interval to the surface;

obtaining, based on the UBD of the second exploration well, an open hole log of the second exploration well to represent a second reservoir property of the second target interval; and selectively performing, based at least on the measure of the fluid flow of the second exploration well and the open hole log of the second exploration well, the DST of the second exploration well for the second target interval.

11. The system of claim 7, further comprising:

a multi-phase separator device for separating a fluid sample of the first target interval from the fluid flow to the surface into at least an oil sample and a gas sample, wherein the oil sample and the gas sample are analyzed to determine a second reservoir property of the first target interval, and wherein the second reservoir property comprises an oil property and a gas property of the first target interval.

12. A non-transitory computer readable medium (CRM) storing computer readable program code for performing a drill stem test (DST), wherein the computer readable program code, when executed by a computer, comprises functionality for:

performing underbalanced drilling (UBD) of a plurality of exploration wells to penetrate a first target interval in a subterranean formation, wherein a wellbore fluid pressure is less than a formation fluid pressure to allow a fluid flow from the first target interval to surface during a drilling phase of the UBD;

determining, based on the UBD of the plurality of exploration wells, a measure of the fluid flow from the first target interval to the surface;

obtaining, based on the UBD of the plurality of exploration wells, open hole logs of the plurality of exploration wells, wherein the open hole logs represent a first reservoir property of the first target interval;

analyzing the measure of the fluid flow and the open hole logs to generate a UBD-derived estimated potential of the first target interval to produce hydrocarbons;

selectively performing, based at least on the measure of the fluid flow and the open hole logs, the DST of the plurality of exploration well;

generating, by at least correlating the UBD-derived estimated potential and a corresponding DST result across the plurality of exploration wells for a plurality of target intervals, a machine learning model; and generating, using the machine learning model and based on the UBD-derived estimated potential of an additional exploration well separate from the plurality of the exploration wells, a predicted DST result of the additional exploration well, wherein the predicted DST result of the additional exploration well is generated without performing the DST of the additional exploration well.

13. The non-transitory CRM of claim 12, wherein selectively performing the DST is based at least on the UBD-derived estimated potential.

14. The non-transitory CRM of claim 13, wherein selectively performing the DST comprises:

performing, in response to the UBD-derived estimated potential of a first exploration well of the plurality of exploration wells meeting a pre-determined criterion, the DST of the first exploration well for the first target interval; and eliminating, in response to the UBD-derived estimated potential of a second exploration well of the plurality of exploration wells failing to meet the pre-determined criterion, the second exploration well from performing the DST for the first target interval, wherein the measure of the fluid flow comprises a fluid flowrate, and wherein the second exploration well is designated as a non-flowing well for the first target interval.

15. The non-transitory CRM of claim 14, wherein selectively performing the DST further comprises:

performing, further in response to the estimated potential of the second exploration well failing to meet the pre-determined criterion, the UBD of the second exploration well to penetrate a second target interval beneath at least the first target interval;

determining, based on the UBD of the second exploration well, the measure of the fluid flow of the second exploration well from the second target interval to the surface;

obtaining, based on the UBD of the second exploration well, an open hole log of the second exploration well to represent a second reservoir property of the second target interval; and selectively performing, based at least on the measure of the fluid flow of the second exploration well and the open hole log of the second exploration well, the DST of the second exploration well for the second target interval.

16. The non-transitory CRM of claim 12, wherein the computer readable program code, when executed by the computer, further comprises functionality for:

obtaining a fluid sample of the first target interval from the fluid flow to the surface; and analyzing the fluid sample to determine a second reservoir property of the first target interval, wherein selectively performing the DST is further based on the second reservoir property of the first target interval.

17. The non-transitory CRM of claim 16, wherein the computer readable program code, when executed by the computer, further comprises functionality for:

separating, using a multi-phase separator device, the fluid sample into at least an oil sample and a gas sample, wherein analyzing the fluid sample comprises analyzing the oil sample and analyzing the gas sample, and wherein the second reservoir property comprises an oil property and a gas property of the first target interval.

* * * * *